US005374169A

United States Patent [19]

Talaski

[11] Patent Number: 5,374,169

[45] Date of Patent: Dec. 20, 1994

[54] FUEL PUMP TUBULAR PULSE DAMPER

[75] Inventor: Edward J. Talaski, Caro, Mich.

[73] Assignee: Walbro Corporation, Cass City, Mich.

[21] Appl. No.: 116,911

[22] Filed: Sep. 7, 1993

[51] Int. Cl.[5] ..... F04B 11/00

[52] U.S. Cl. ..... 417/540; 138/26

[58] Field of Search ..... 417/540, 543, 366; 138/26

[56] References Cited

U.S. PATENT DOCUMENTS 2,530,190 11/1950 Carver ..... 138/26
4,113,434 9/1978 Tanaka et al. ..... 23/232 R
5,035,588 7/1991 Tuckey ..... 417/540
5,122,039 6/1992 Tuckey ..... 417/366

*Primary Examiner*—Richard E. Gluck
*Attorney, Agent, or Firm*—Barnes, Kisselle, Raisch, Choate, Whittemore & Hulbert

[57] ABSTRACT

A pressure pulse damper for a vehicle fuel pump which dampens output fuel pressure pulses and reduces audible noise emanating from the pump. The damper is a thin-wall tube pinched off and sealed at its ends to form at least one chamber, with a compressible gas sealed therein preferably at superatmospheric pressure. Preferably to provide multiple chambers with gas therein, the tube is also pinched together and sealed at locations between its ends.

15 Claims, 1 Drawing Sheet

FUEL PUMP TUBULAR PULSE DAMPER

FIELD OF THE INVENTION

This invention relates to fuel pumps and more particularly to a fluid pulse and noise damper for an automotive vehicle fuel system and the like.

BACKGROUND OF THE INVENTION

U.S. Patent No. 5,122,039 discloses a gerotor-type fuel pump that internally carries an elastomeric pressure pulse damper containing air at atmospheric pressure within a closed hollow and circumferentially continuous annular body which functions to reduce pressure pulsations in the fuel output to enhance pump delivery and reduce audible noise. Fuel is pumped by the action of a pair of intermeshing inner and outer gear rotors positioned within a housing which produce pressure pulses or variations in the pressure of the fuel discharged from the pump. The pressure pulse damper contracts and expands when subjected to these pressure pulses in the fuel which reduces the magnitude of the pressure pulses and provides a more steady flow of fluid through the pump outlet.

Although the pressure pulse damper of the gerotor-type fuel pump disclosed in the noted patent, assigned to the assignee hereof, has enjoyed substantial commercial acceptance and success, improvements remain desirable. One problem with the pressure pulse damper disclosed in the noted patent is the limited durability of the damper as well as the reliability of the device in operation. This pressure pulse damper must be blow molded from a family of plastic materials suitable for blow molding operations which produces considerable scrap material which increases the cost of production. Additionally, blow molded dampers must be carefully designed to obtain a geometry which has an easily compressible portion that flexes, but does not "oil-can", when compressed. To design a durable damper which readily flexes under repeated cyclic loading, special care must be taken to reduce localized stresses which might cause fatigue fractures to the blow molded damper. Therefore, to obtain a damper capable of withstanding full-compression cycle loading, the geometry of the damper becomes critical to minimize fatigue fracturing. Furthermore, the blow-molding operations and assembly process for an annular-shaped damper further increases the final cost of the damper.

Another problem with existing pressure pulse dampers is inadequate reliability and insufficient useful life for the normal life cycle of the fuel pump. The difficulty of designing a blow-molded damper which is sufficiently flexible increases the likelihood that local fatigue fractures will cause a failure of the damper. Likewise, the ability to develop a multi-chamber damping device which is simple to produce, cost effective, and readily made by a blow molding process has proved to be difficult to achieve to date. The reliability and useful life of the current single chamber damper is highly dependent on critical design geometry, the ability to repeatedly achieve full compression without cyclic failure, and stringent control of the wall thickness of the resulting blow molded damper.

SUMMARY OF THE INVENTION

A pressure pulse damper with a hollow body formed of a thin walled tube of flexible and resilient plastic material with heat sealed ends forming at least one chamber in the body. Each chamber carries a compressible gas, preferably under pressure, to dampen pressure pulsations in fuel delivered by a fuel pump and to steady the flow of fuel by reducing pressure pulsations without decreasing pump delivery. When a multiple chamber damper is utilized, reliability is increased because failure of one chamber still provides the remaining chambers for pulse damping. In addition, each chamber also reduces audible noise produced by the pressure pulsations, thereby minimizing noise within a vehicle having a fuel pump with the damper.

Objects, features and advantages of this invention are to provide a pressure pulse damper for a fuel pump which is easily and economically produced from a continuous hollow tube, can provide single or multiple chambers therein, can be completely compressed due to the flexible material construction and thin-wall geometry, has a significantly longer useful life, and is simple, stable, rugged, durable, reliable, quick and easy to assemble, and of relatively simple design and economical manufacture and assembly.

BRIEF DESCRIPTION OF THE DRAWINGS

These and other objects, features and advantages of this invention will be apparent from the following detailed description, appended claims and accompanying drawings in which:

DETAILED DESCRIPTION

Figure 1:
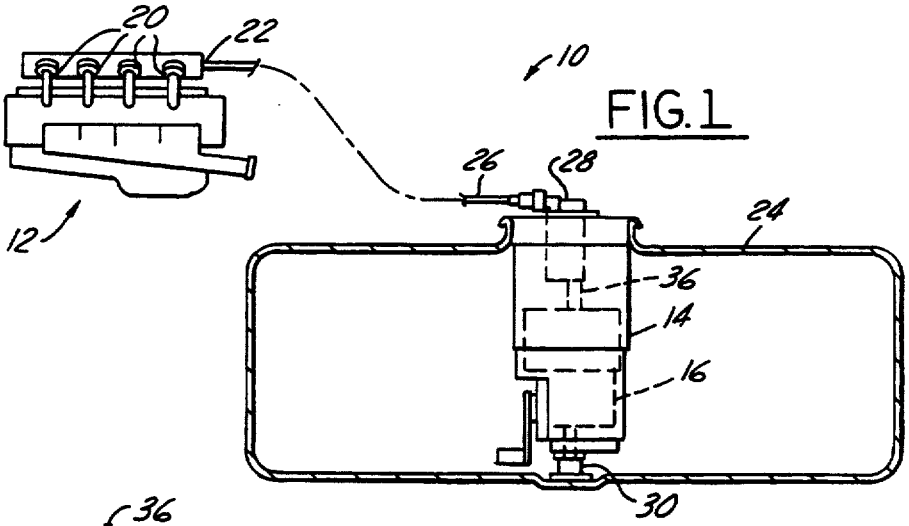
FIG. 1 is a schematic view of a vehicle engine and fuel delivery system embodying this invention.

FIGS. 1–4 illustrate a fuel delivery system 10 for a vehicle engine 12 with an in-tank fuel pump module 14 with a fuel pump 16 having therein a pressure pulse damper 18 embodying this invention. Preferably, the engine has an electronic fuel injection system with a fuel injector 20 for each cylinder to which liquid gasoline fuel is supplied through a common fuel rail 22. Preferably, the fuel pump module 14 is received in a fuel tank 24 of a vehicle, such as an automobile (not shown), and supplies fuel to the fuel rail through an interconnecting fuel line 26. Preferably, the speed and the hence the output of the pump is varied to supply liquid fuel to the rail at the desired pressure and there is no fuel return line from the rail. This fuel system is commonly known as a returnless fuel system.

In assembly, the pump 16 is mounted in the module 14 and supplies fuel under pressure to the fuel line 26 preferably through a check valve assembly 28. Fuel is admitted to the module through an inlet and filter assembly 30 adjacent the bottom of the tank.

Figure 2:
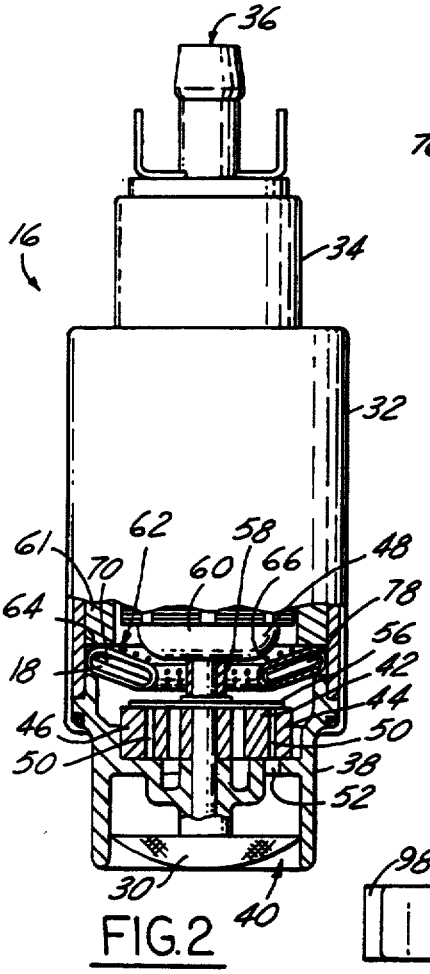
FIG. 2 is a partial sectional side view of a self-contained fuel pump having a pressure pulse damper in accordance with a presently preferred embodiment of the invention as utilized in FIG. 1.

As shown in FIG. 2, the fuel pump has a generally cylindrical case 32 with an upper end cap 34 having a pressurized fuel outlet 36 and a lower end cap 38 with a fuel inlet 40. When assembled in the module, the pump outlet 36 is connected to the check valve assembly 28 and the inlet 40 receives fuel through the module filter and inlet 30.

To pump fuel, a pair of meshed inner and outer gear rotors 42 and 44 are received in a pocket 46 in the lower cap 38 and rotated by an electric motor 48. As the gears rotate, the spaces between their intermeshing teeth provide circumferentially disposed expanding and ensmalling pumping chambers 50 to which liquid fuel is admitted on one side through an inlet port 52. The fuel is discharged through a wedged shaped outlet (not shown), in the bottom of the pocket 46 in the end cap 38 and passes radially outwardly of the outer gear 44 and into the interior of the pump 54, through its case 32, upper end cap 34 and the outlet 36. A seal plate in the form of a disc 56 is received on the upper side of the gears 42 and 44. For driving the gears, the inner gear 42 is connected to the drive shaft 58 of the armature 60 which is journaled for rotation in the stator 61 of the motor. Since the construction and operation of a suitable pump 16 is described in greater detail in U.S. Patents Nos. 4,697,995 and 5,122,039, the disclosures of which are incorporated herein by reference, it will not be described in further detail.

As shown in FIG. 2, preferably damper 18 is received in an annular cage 62 which in assembly is received and trapped in a recess or groove 64 between and formed by the lower end of the stator 61 and the upper end of the lower cap 38. However, in some applications, the damper 18 can be installed directly in the pump without any cage 62.

Preferably, the cage is annular, discontinuous, and has an arcuate extent of more than 180°, less than 360°, preferably about 300° and in cross section conforms with the periphery of the damper in its relaxed state. Preferably, the cage in cross section is generally oval in form with generally semi-circular side edges connected by substantially linear sidewalls. Preferably, the cage is perforated with a plurality of fluid ports 66 through which the pressurized fuel acts on the damper. Preferably, the number and size of the ports are selected and dimensioned to provide a controlled rate of fuel flow acting on the damper. Preferably, the cage is constructed from a corrosion resistant material such as plastic, brass, copper, stainless steel or the like, and may be formed from a wire screen or mesh. Preferably, when the cage is made an open end is provided for inserting the damper 18, and if desired after insertion of the damper it may be pinched shut to retain it.

Figure 3:
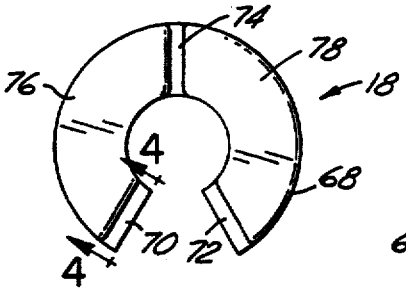
FIG. 3 is a top view illustrating the pressure pulse damper of the fuel pump of FIG. 2.
Figure 4:
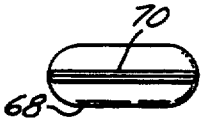
FIG. 4 is an end view of the damper of FIG. 3 taken substantially along the line 4—4 in FIG. 3.
Figure 5:
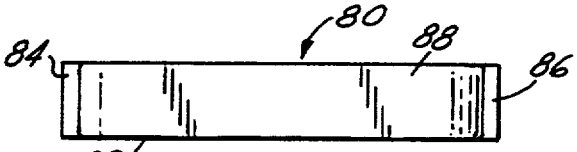
FIG. 5 is a top view of an elongate hollow tube pressure pulse damper illustrating a modified embodiment of the invention.

As shown in FIGS. 3 and 4, preferably the pulse damper 18 is constructed in the shape of a discontinuous annular ring or arcuate segment of more than 180°, less than 360°, and preferably about 300° from a hollow and thin wall tube 68 of a flexible and resilient plastic material, such as Teflon ®. Preferably, the tube is disposed in a generally arcuate configuration while its ends 70 & 72 are pinched together and sealed. Preferably, the tube is also pinched and sealed together at one or more intermediate portions 74 to form a plurality of hollow chambers 76 & 78 with a quantity of gas, such as air, therein. Preferably, the gas in each chamber is compressed above atmospheric pressure, although it may be more or Less at or below atmospheric pressure. Preferably, the ends 70, 72 and the intermediate portions 74 are heat sealed together, such as by being pressed together between heated dies, or bars although they may be secured and sealed together by a suitable adhesive. Heat sealing with gas in the chambers at super-atmospheric pressure can be easily achieved by applying compressed gas to the interior of the tube through one or both ends before and while heat sealing the intermediate portions and the ends.

Figure 6:
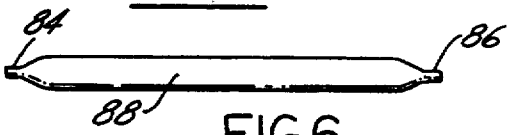
FIG. 6 is a side view of the pressure pulse damper of FIG. 5.

As shown in FIG. 6, an elongate linear damper 80 may be made and inserted in the cage which disposes it in a generally annular or arcuate configuration in the pump. The damper may be made from a generally linear thin wall piece of tube 82 of a flexible and resilient plastic material, such as Teflon or PTFE ®, by pinching together and sealing its ends 84 & 86, such as by heat sealing or with a suitable adhesive to form a chamber 88 with gas therein, which is preferably at a super-atmoshheric pressure when the damper is in its relaxed state.

Figure 7:
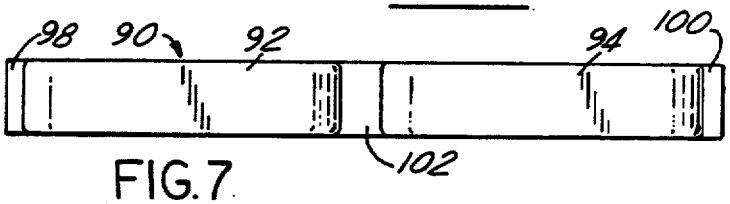
FIG. 7 is a top view of a modified embodiment of the invention shown in FIGS. 5 and 6.
Figure 8:
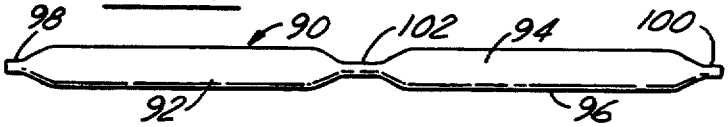
FIG. 8 is a side view of the pressure pulse damper of FIG. 7.

As shown in FIGS. 7 and 8, an elongate linear damper 90 with multiple chambers 92 & 94 can be produced by heat sealing a thin wall tube 96 of a suitable palstic material at its ends 98 & 100 and one or more intermediate portions 102. Preferably, the gas in chambers 92 & 94 is at superatmospheric pressure when the damper is in its relaxed state.

If desired, these dampers can be used in a generally linear configuration by disposing them in a pump housing constructed to accommodate their linear configuration.

Preferably, a plurality of these dampers can be fabricated from a single long piece or continuous roll of suitable flexible and resilient plastic tubing of the desired diameter by disposing a portion adjacent one end thereof in the desired arcuate or linear configuration, pinching together and sealing, such as by heat sealing, the ends and all intermediate portions thereof and thereafter severing or cutting off the formed damper from the continuous tube adjacent the sealed end distal from the free end of the tube to provide gas preferably at super-atmospheric pressure in the chambers. It is preferable to supply the compressed gas to the continuous tube from the other end thereof, and it is preferable to close and seal the leading end of the immediately succeeding a completed damper before severing the completed damper from the continuous tube.

The dampers are fabricated from a tube having a relatively thin wall, which is usually in the range of about 0.002 to 0.050, and preferably 0.008 to 0.012 of an inch. For automotive fuel pump applications, the tube typically has an outside diameter in the range of about 0.1 to 2.0, preferably 0.12 to 0.5 of an inch. Preferably, the thin wall tube is extruded from a plastic material. The resilient plastic material needs to be one which does not substantially swell or deteriorate when in use and in continuous contact with the fuel in which it is submerged. For automotive applications a plastic material, such as Teflon, Mylar, Acetal, or Valox is suitable for use with gasoline, gasohol (gasoline with alcohol mixed therein), and diesel oil fuels. For some applications, Nylon or like material, may be suitable and the material cost of the tube can be reduced by coextruding a Teflon or PTFE ® outer covering over a Nylon ® core.

To maximize the dampening of pressure pulses and the reduction of noise, it is believed to be preferable to design and test the geometry of the damper and select the pressure of the gas in the chamber (s) so that under normal operating conditions, the pressure pulses of the greatest magnitude substantially completely collapse each chamber so that its generally opposed sidewall portions bear on one another. Usually, the pressure of the gas in each chamber is somewhat lower than the nominal operating pressure of the fuel in which the damper is disposed. Typically, the pressure of this gas is about 5% to 30% and preferably about 5% to 20% less than the nominal fuel pressure. For example, a damper disposed in fuel with a nominal operating pressure of 60 psig may have a gas pressure in each chamber of about 50 to 55 psig when the damper is disposed in the atmosphere.

The dampers embodying this invention are of a relatively simple design and economical manufacture and assembly, provide superior dampening performance and noise reduction and a significantly longer useful life at substantially less manufacturing and assembly cost than prior art commercial dampers.

What is claimed is:

1. A fuel pressure pulse damper in a fuel pump comprising: a hollow body of a thin walled tube of a flexible and resilient plastic material having a pair of spaced apart ends, the wall of the tube being pinched together and sealed adjacent each said end and in at least one portion between said ends to form in cooperation with the tube at least two chambers therein, a compressible gas hermetically sealed in each said chamber, and said hollow body being carried by the fuel pump in contact with fuel discharged by the pump so that said hollow body is compressed by pressure pulses in the discharged fuel to dampen the pressure pulses and steady the flow of fuel from the fuel pump.

2. The damper of claim 1 wherein the tube is disposed in the configuration of a discontinuous annular ring extending through an arcuate segment of more than 180° and less than 360°.

3. The damper of claim 1 wherein said hollow body is generally oval in cross section.

4. The damper of claim 1 which further comprises a rigid cage having at least one port for admitting fuel and said cage encircles, supports and carries said hollow body in the fuel pump.

5. The damper of claim 1 wherein said plastic material is PTFE.

6. The damper of claim 1 wherein said compressible gas in each said chamber is at superatmospheric pressure and the wall of said tube is heat sealed where pinched together.

7. The damper of claim 1 wherein when the damper is exposed to atmospheric pressure the gas hermetically sealed in each said chamber has a superatmospheric pressure which is in the range of 5% to 30% less than the nominal pressure of fuel discharged from the pump when operating.

8. The damper of claim 1 wherein in cross section the wall of the tube has an outside diameter in the range of about 0.1 to 0.5 to an inch.

9. The damper of claim 1 wherein the wall of the tube has a nominal thickness of about 0.002 to 0.05 of an inch.

10. A fuel pressure pulse damper for a fuel system having a fuel pump comprising: a hollow body of a thin walled tube of a flexible and resilient plastic material having a pair of spaced apart ends, the wall of the tube being pinched together and sealed adjacent each said end and in at least one portion between said ends to form in cooperation with the tube at least two chambers therein, a compressible gas hermetically sealed in each said chamber, and said hollow body is compressed by pressure pulses in the discharged fuel to dampen the pressure pulses and steady the flow of fuel discharged from the fuel pump.

11. The damper of claim 10 wherein said compressible gas in each said chamber is at superatmospheric pressure and the wall of said tube is heat sealed where pinched together to form said chambers.

12. The damper of claim 10 which further comprises a rigid cage having at least one port for admitting fuel and said cage encircles, supports and carries said hollow body in contact with the liquid fuel.

13. A fuel pressure pulse damper for a fuel pump comprising: a hollow body of a thin walled tube of a flexible and resilient plastic material having a pair of spaced apart ends, the wall of the tube being pinched together and sealed adjacent each said end and in at least one portion between said ends to form in cooperation with the tube at least two chambers therein, a compressible gas hermetically sealed in each said chamber, and said hollow body being constructed to be carried by the fuel pump in contact with fuel discharged by the pump so that said hollow body is compressed by pressure pulses in the discharged fuel to dampen the pressure pulses and steady the flow of fuel from the fuel pump.

14. The damper of claim 7 which further comprises a rigid cage having at least one port for admitting fuel and said cage encircles, supports and carries said hollow body in the fuel pump.

15. The damper of claim 13 wherein said compressible gas in each said chamber is at superatmospheric pressure and the wall of said tube is heat sealed where pinched together to form said chambers.

* * * * *

UNITED STATES PATENT AND TRADEMARK OFFICE

CERTIFICATE OF CORRECTION

PATENT NO. : 5,374,169

DATED : December 20, 1994

INVENTOR(S) : Edward J. Talaski

It is certified that error appears in the above-identified patent and that said Letters Patent is hereby corrected as shown below:

Col. 4, Line 24, change "palstic" to — plastic —.

Col. 6, Line 44, change "claim 7" to — claim 13 —.

Signed and Sealed this

Fourteenth Day of March, 1995

Bruce Lehman

*Attest:*

BRUCE LEHMAN

*Attesting Officer*

*Commissioner of Patents and Trademarks*